US005092372A

United States Patent [19]

Fitzka et al.

[11] Patent Number: 5,092,372

[45] Date of Patent: Mar. 3, 1992

[54] PAPER FORMING FABRIC WITH PARTNER YARNS

[76] Inventors: Karl M. Fitzka, Franz-Binder-Gasse 5, A-2640, Gloggnitz, Austria; Fritz Vöhringer, Dachsweg 4, D-7920, Heidenheim, Fed. Rep. of Germany

[21] Appl. No.: 548,296

[22] Filed: Jul. 5, 1990

[30] Foreign Application Priority Data

Jul. 19, 1989 [DE] Fed. Rep. of Germany ..... 3923938

[51] Int. Cl.[5] ..... D03D 13/00; D03D 25/00

[52] U.S. Cl. ..... 139/383 A; 162/DIG. 1; 139/410

[58] Field of Search ..... 162/Dig. 1; 139/383 A, 139/410, 413, 408, 409, 425 A

[56] References Cited

U.S. PATENT DOCUMENTS 4,518,644 5/1985 Vuorio ..... 139/383 A
4,821,780 4/1989 Tate ..... 139/413 X
4,832,090 5/1989 Krenkel et al. ..... 139/383 A
4,909,284 3/1990 Kositzke ..... 139/383 A
4,934,414 6/1990 Borel ..... 139/383 AS
4,945,952 8/1990 Vohringer ..... 139/410 X

*Primary Examiner*—Andrew M. Falik
*Attorney, Agent, or Firm*—Gifford, Groh, Sprinkle, Patmore and Anderson

[57] ABSTRACT

A forming fabric for the forming areas of a paper making machine having at least two complete woven fabrics which are jointly woven by binding yarns extending in longitudinal or cross directions. Partner yarns are added to at least a part of the longitudinal direction yarns and/or the cross direction yarns of the forming fabric. The partner yarns extend at least in one weave repeat pattern parallel to the respective longitudinal direction and/or cross direction yarns. The partner yarns further have the same binding weave pattern as the longitudinal or cross direction yarns which results in changing of the number of the longitudinally-directed fiber supporting points with respect to the number of cross direction fiber supporting points in the forming fabric.

12 Claims, 2 Drawing Sheets

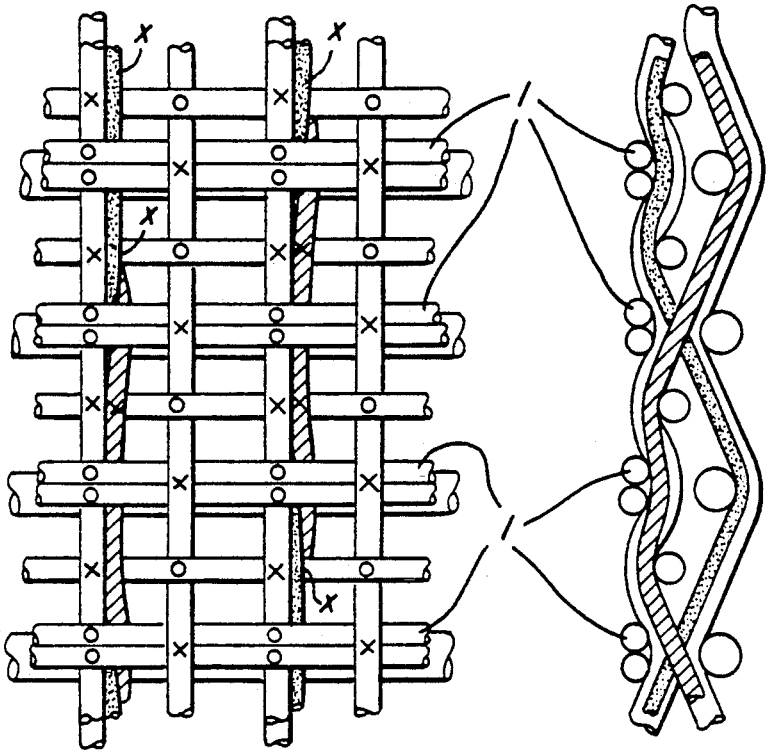
Fig-3
Fig-3A
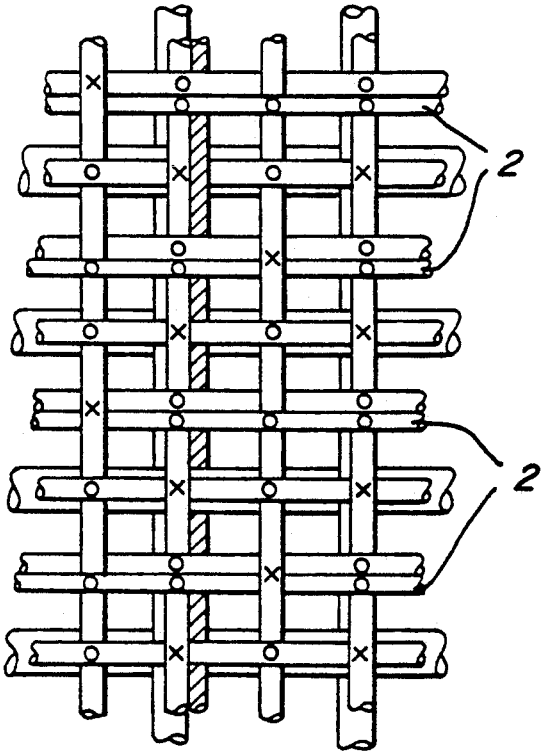
Fig-4

PAPER FORMING FABRIC WITH PARTNER YARNS

BACKGROUND OF THE INVENTION

The invention relates to the forming fabric for the forming area or wet end of a paper making machine. The forming fabric has at least two complete fabrics of any kind of binding which are jointly woven by binding yarns running in a longitudinal or machine direction and/or cross-machine direction so that the longitudinal yarns of the fabric are forming longitudinally directed fiber supporting points whereas the yarns in cross-machine direction are forming cross-machine direction fiber supporting points.

Multilayer sieves and compound fabrics, especially paper making fabrics the single layers of which are connected by a binding warp or a binding weft are well known in the art. Such fabrics are used for the manufacture of a multiplicity of kinds of paper, such as coarse papers and papers for cigarettes and condensors. It goes without saying that coarse papers, such as packing or wrapping papers must fulfill stability and tensile strength requirements completely more so than other requirements than for other papers such as cigarettes. The last mentioned papers are less critical with respect to the tensile strength but critical with respect to a defined permeability for air. On the other hand, the paper for newspapers or for printing purposes must fulfill special requirements with respect to their imprinting ability. These different requirements and demands are essentially influenced by the original paper forming process occurring in the forming area or wet part of a paper making machine. In that area the fibers of the pulp are generally uniformly distributed and directed as well as curled and matted together or clogged, whereas simultaneously the pulp is dewatered in order to develop the original fiber web. The surface structure of the forming fabric is therefore of absolute essential importance for the character of the paper to be manufactured.

On adapting the surface structure of the forming fabric to the special requirements the relationship of the fiber supporting points in longitudinal direction of the fibers and those fiber supporting points in fiber cross-machine direction is therefore of essential importance. By the term "fiber supporting point" all those fiber surface parts are understood to be extending uprightly away from the level of the sheet forming area of the forming fabric and in touch with the fibers of the pulp. In order to more clearly point out this matter attention is drawn to FIGS. 1 and 2 of the drawings showing known forming fabrics of paper making machines. These known fabrics are characterized with respect to FIG. 1 by an even relationship between the fiber supporting points in machine direction or longitudinal direction and cross-machine direction, i.e. these points are present in a relationship of 1:1, whereas according to FIG. 2 the fiber supporting points in machine direction dominate clearly those in cross machine direction, i.e. their number is greater.

In the past the influence of the fiber supporting points of those forming fabrics having a definite direction could only be changed by the fixing process of the fibers during which the related fiber supporting points could be put to a more or less prepositioned level, i.e. to a level adjacent to the paper sheet forming level in order to provide for those fiber supporting points during the sheet forming process the required dominating effect. This "shifting" of the fiber supporting points to a prepositioned level results, however, in disadvantages with respect to the quality of the paper to be manufactured. These disadvantages can result in the kind of paper being so strong that such a change of fiber supporting points can basically not be permitted. The essential drawbacks with respect to the quality are the diminishing of the smoothness of the surface and of the printing ability of the papers.

SUMMARY OF THE INVENTION

An object of the invention therefore resides in the manufacture of a forming fabric for the forming area or wet part of a paper making machine which avoids the above mentioned drawbacks.

According to a further object of the subject invention the surface structure of the paper which is to be manufactured should be adapted to the respective kind of use of the requested characteristic features by means of a special kind of binding without changing the character of the basic binding of the forming fabric.

These and other objects are solved according to the subject invention by the addition of so-called partner yarns to at least a part of the longitudinal yarns and/or cross yarns of the forming fabric. These partner yarns are running within at least one weave parallel and thus with the same binding to the respective longitudinal yarns and/or cross-machine directions yarns and change the relation between the number of the longitudinal directed or machine direction fiber supporting points and the number of the cross directed or cross-machine direction fiber supporting points of the forming fabric.

Thus, partner yarns are associated threads, which are added to special yarns of the given weave binding of the forming fabric, i.e. these yarns are at least partly interwoven in the same manner as those yarns to which they are added. These partner yarns have therefore the effect that they provide at least at some locations to which they are added form fiber supporting points. A duplication of these supporting points causes the sheet forming surface of the yarns to be increased correspondingly because they form adjacent to the first point a second point.

As the number of partner threads can be chosen it is possible to choose that number for forming fabrics having between the present fiber supporting points in cross machine direction and in machine direction of the fabric a great difference, in such a way that in both mentioned directions the same number of fiber supporting points are provided within the fabric. Moreover, it is possible to choose the number of partner threads such that the number of fiber supporting points in cross machine direction is greater than the number of fiber supporting points in machine direction. That choice depends on the required surface condition of the paper to be manufactured.

In this connection it has been found to be especially advantageous to choose for the partner yarns 1 (FIG. 3) the same cross section as that of the yarns they are added or associated to.

Thus, it is possible, on maintaining specific qualities or properties of the papers which are to be manufactured, for instance stability, stiffness, and wear resistance to adapt other properties, for instance ability for printing to special requirements by a planned change of the surface structure of the fabric construction. Such requirements are, for instance, curling of the fibers during the beginning of the paper sheet formation, without waving other advantageous properties of a well-tried sieve or fabric construction.

It is known from double-layer paper machine fabrics to use on the forming side of the fabric floating yarns however, these yarns are not comparable with respect to their binding with the partner yarns of the subject invention, because they do not run in any weave repeat in the same binding as any adjacent yarn. Therefore, by interweaving of floating yarns the character of the given binding of the fabric is completely changed, whereas in contrast thereto the character of the binding is maintained if the so-called partner yarns are interwoven. Moreover, because of the above the floating yarns fulfill another object. Thus, they are also used for the improvement of the retention ability for fibers by dividing the distances of the cross yarns, i.e. the widths of the meshes, into two halves. This partition of the mesh widths is only possible, however, if the floating yarns do not have the same binding.

BRIEF DESCRIPTION OF THE DRAWINGS

A better understanding of the invention will be reached by reference to the following detailed description when read in conjunction with the accompanying drawings. In the drawings:

FIG. 3 is a plan view and a longitudinal section view of the forming fabric according to the subject invention in which the prevailing number of the fiber supporting points in machine direction in the original fabric is equalized by partner yarns in cross machine direction.

FIG. 4 is a plan view of another embodiment of the forming fabric according to the subject invention, in which by interweaving of partner yarns the even relation of fiber supporting points in machine direction and cross machine direction in the original fabric is changed such that the number of fiber supporting points in cross machine direction has become greater.

DETAILED DESCRIPTION

Figure 1:
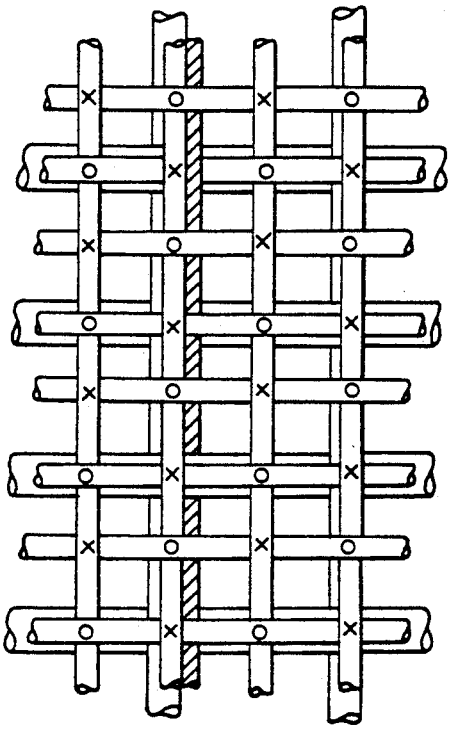
Fig-1 PRIOR ART
FIG. 1 is a plan view of a known forming fabric for a paper making machine according to the claimed kind of fabrics provided with the same number of fiber supporting points in machine direction and fiber supporting points in cross machine direction.

Referring at first to FIG. 1 showing a known forming fabric in which the fiber supporting points in longitudinal or machine direction are marked by an x, whereas the fiber supporting points in cross-machine direction are marked by a circle. From this marking can be gathered that the relation of the number of the fiber supporting points in machine direction to the number of fiber supporting points in cross-machine direction is equal.

Figure 2:
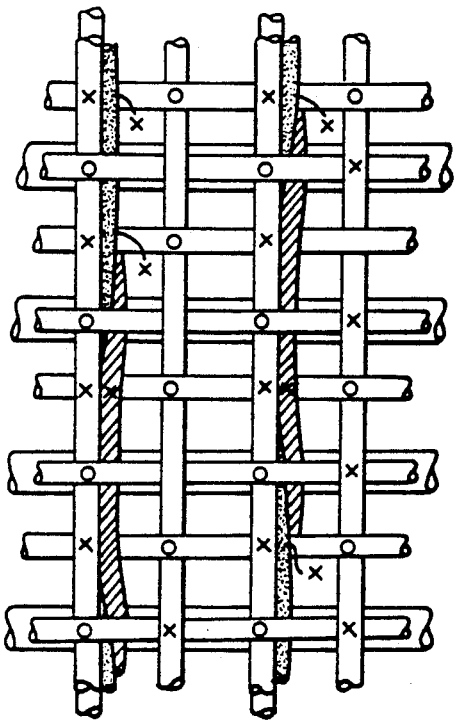
Fig-2 PRIOR ART
FIG. 2 is a plan view and a longitudinal section view of a known forming fabric of a paper making machine according to the claimed kind of fabric provided with a prevailing number of fiber supporting points in machine direction.
Figure 2A:
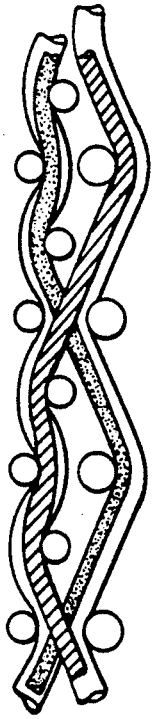

FIG. 2 shows also a known forming fabric in linen-binding in which the fiber supporting points in machine direction, which are also marked by an x, however, do not clearly dominate the fiber supporting points in cross machine direction.

In order to influence with those known forming fabrics the paper sheet forming process with respect to distribution, alignment, curling and mattforming of the fibers within the initial fiber mat establishing process on the forming fabric in such a way that the required surface characteristics of the paper to be manufactured is gained, such as for instance smoothness and printing ability, at least part of the yarns in machine direction and/or cross-machine direction of the forming fabric are associated with partner yarns, which run at least in one weave repeat parallel and thus in the same binding to the respective yarns in machine direction and/or cross-machine direction so that the relationship of the number of the fiber supporting points in machine direction to the number of the fiber supporting points in cross-machine direction of the forming fabric is changed.

Thus, in the forming fabric structure as shown in FIG. 3 the number of the fiber supporting points in machine direction marked by x was originally greater than the number of the fiber supporting points in cross-machine direction marked by a circle. By interweaving partner yarns 1 running parallel to the cross directed yarns so that to each second yarn of the present forming fabric having a linen-binding a partner yarn 1 is associated extending in all adjacent weave repeats parallel thereto which means it has the same binding, the number of fiber supporting points in cross-machine direction has been increased to such an extent that the original difference between those numbers has now been equalized. Thus, each second yarn in cross machine direction of the forming fabric is present twice. Nevertheless, the character of the original fabric is not changed by these partner yarns or threads. Its specific properties as for instance stability, stiffness, wear resistence, dewatering capacity, remain essentially unchanged or are changed by the inclusion of partner yarns 1 in a tolerable extent.

According to the embodiment of the forming fabric as shown in FIG. 4 which is a further development of the known embodiment as shown in FIG. 1, each second cross-machine direction extending yarn of the forming fabric is associated with a partner yarn 2, so that the partner yarns extend only in each second one of the adjacent weave repeat with the same binding. Thus, the partner yarns are not bound into the weave within those weave repeats located between the above mentioned weave repeats . That means that the same number of fiber supporting points in machine and cross-machine direction which was originally present has been changed such that now the number of the fiber supporting points in cross-machine direction is dominant. These fiber supporting points are marked with a circle. The partner yarns 2 are thus bound in the relation 3:1, which means that this yarns extend over three longitudinal yarns, i.e. yarns in machine direction, and afterwards below one longitudinal yarn. Therefore, the partner threads 2 differ from the given associated cross-machine yarns insofar as they are crossed by a longitudinal yarn only in each second one of the adjacent weave repeats and thus are interwoven only at that location.

Thus, the principle of binding of the partner yarns 1 and 2 which could also be interwoven in longitudinal direction as well is clearly defined.

It goes without saying that in contrast to the embodiments of the forming fabrics as shown by the FIGS. 3 and 4 corresponding to the invention it is also possible to associate each of the yarns in cross-machine direction or machine direction with a partner yarn and not only each second one of those yarns.

We claim:

1. A forming fabric for the forming area of paper of a paper making machine, comprising an upper and a lower woven fabric which are jointly woven by binding yarns extending in a machine direction or cross-machine direction so that the machine direction yarns of said upper fabric form longitudinally directed fiber supporting points whereas the cross-machine direction yarns of said upper fabric form cross directed fiber supporting points, characterized by the addition of partner yarns to preselected ones of said cross-machine direction yarns of the upper fabric, said partner yarns extending at least in one weave repeat parallel to the cross-machine direction yarns and having therefore the same binding weave pattern and thus changing the relation of the number of the longitudinally directed fiber supporting points to the number of the cross-machine direction fiber supporting points of said forming fabric.

2. The forming fabric according to claim 1, wherein a number of said partner yarns is selected such that the number of said longitudinally directed fiber supporting points is equal to the number of said fiber supporting points in the cross-machine direction.

3. The forming fabric according to claim 1 wherein a number of said partner yarns is selected such that the number of said fiber supporting points in the cross-machine direction is greater than the number of said fiber supporting points in machine direction corresponding to the longitudinal direction.

4. The forming fabric according to claim 1 wherein in the case of a linen-binding weave pattern of said forming fabric each second yarn in said cross-machine direction is associated with one of said partner yarns contacting said cross-machine direction yarn in a cross-machine direction and having the same diameter as said second cross-machine direction yarn.

5. The forming fabric according to claim 2 wherein in the case of a linen-binding weave pattern of said forming fabric each second yarn in the cross-machine direction is associated with one of said partner yarns contacting said cross-machine direction yarn in a cross-machine direction and having the same diameter as said cross-machine direction yarn.

6. The forming fabric according to claim 3 wherein in the case of a linen-binding weave pattern of said forming fabric each second yarn in said cross-machine direction is associated with one of said partner yarns contacting said cross-machine direction yarn in cross-machine direction and having the same diameter as said cross-machine yarn.

7. The forming fabric according to claim 1 wherein in the case of a linen-binding weave pattern of said forming fabric, each second yarn in said cross-machine direction of said fabric is associated with one of said partner yarns contacting said cross-machine direction yarn and having a smaller diameter than said cross-machine direction yarn, and so that said partner yarns extend only in each second repeat of said linen-binding weave pattern in said cross-machine direction with the same binding and are not bound into a weave located between each second repeat of said linen-binding weave pattern in said cross-machine direction.

8. The forming fabric according to claim 2, wherein in the case of a linen-binding weave pattern of said forming fabric each second yarn in the cross-machine direction of said fabric is associated with one of said partner yarns contacting said cross-machine direction yarn and having a smaller diameter than said cross-machine direction yarn so that said partner yarn extends only in each second repeat of said linen-binding weave pattern in the cross-machine direction with the same binding and is not bound into a weave pattern located between each second repeat of said linen-binding weave pattern in said cross-machine direction.

9. The forming fabric according to claim 3 wherein in the case of a linen-binding weave pattern of said fabric each second yarn in cross-machine direction of said fabric is associated with one of said partner yarns contacting said cross-machine direction yarn and having a smaller diameter than said cross-machine direction yarn so that said one of said partner yarns extends only in each second repeat of said linen-binding weave pattern in said cross-machine direction yarn with the same binding and are not bound into a weave pattern located between each second repeat of said linen-binding weave pattern in said cross-machine direction.

10. A forming fabric for the forming area of paper of a paper making machine, comprising at least two complete woven fabrics which are jointly woven by binding yarns extending in a machine direction or a cross-machine direction so that said machine direction yarns of said forming fabric are forming longitudinally directed fiber supporting points and said cross-machine direction yarns are forming cross directed fiber supporting points, characterized by the addition of a partner yarn to each second yarn in said cross-machine direction of said fabric, each said partner yarn contacting said cross-machine direction yarn and having a smaller diameter than said cross-machine direction yarn, and so that said partner yarns extend only in each second cross-machine directed repeat of adjacent weave patterns with the same binding weave pattern and are not bound into a weave pattern located between each second cross-machine directed repeat of said adjacent weave patterns, said partner yarn extends at least in one weave repeat parallel to the respective machine direction yarns and/or cross-machine direction yarns and has the same binding weave pattern and thus changes the relation of the number of the longitudinally directed fiber supporting points to the number of the cross-machine direction fiber supporting points of said forming fabric.

11. A forming fabric for the forming area of paper of a paper making machine, comprising at least two complete woven fabrics of binding which are jointly woven by binding yarns extending in a machine direction or a cross-machine direction so that the machine direction yarns of the fabric are forming longitudinally directed fiber supporting points whereas the cross-machine direction yarns are forming cross directed fiber supporting points, characterized by the addition of yarns at least to selected cross-machine direction yarns of the forming fabric, each second yarn in said cross-machine direction of said fabric is associated with an additional yarn contacting said cross-machine direction yarn, and so that said additional yarns extend only in each second one of an adjacent repeat weave pattern with the same binding and are not bound into a weave pattern located between each second yarn in said cross-machine direction, one additional yarn extends at least in one weave repeat parallel to said cross-machine direction yarns and has therefore the same binding and thus changes the relation of the number of the longitudinally directed fiber supporting points to the number of the cross-machine direction fiber supporting points of said forming fabric, wherein the number of said longitudinally directed fiber supporting points is less than the number of said fiber supporting points in the cross-machine direction.

12. A forming fabric for the forming area of paper of a paper making machine, comprising at least two complete woven fabrics which are jointly woven by binding yarns extending in a linen binding weave pattern in machine or longitudinal direction or cross-machine direction so that the machine direction yarns of the at least two woven fabrics are forming longitudinally directed fiber supporting points whereas the cross-machine direction yarns are forming cross directed fiber supporting points, characterized by the addition of partner yarns to at least said cross-machine direction yarns of the forming fabric, said partner yarns extend at least in one weave repeat parallel to said cross-machine direction yarns and has therefore the same binding and thus changes the relation of the number of the longitudinally directed fiber supporting points to the number of the cross-machine direction fiber supporting points of said forming fabric, wherein the number of said partner yarns is such that the number of said fiber supporting points in cross-machine direction is greater than the number of said fiber supporting points in machine direction corresponding to the longitudinally direction, wherein in said linen-binding of said fabric, each second yarn in said cross-machine direction of said fabric each second yarn in said cross-machine direction of said fabric is associated with one of said partner yarns contacting said cross-machine direction yarn and having a smaller diameter than said cross-machine direction yarn so that said partner yarn extends only in each second one of an adjacent repeat weave pattern with the same binding and is not bound into a weave pattern located between each second yarn in said cross-machine direction.

* * * * *

UNITED STATES PATENT AND TRADEMARK OFFICE

CERTIFICATE OF CORRECTION

PATENT NO. : 5,092,372

DATED : March 3, 1992

INVENTOR(S) : Karl M. Fitzka

It is certified that error appears in the above-identified patent and that said Letters Patent is hereby corrected as shown below:

Claim 7, line 10, after "weave" insert --pattern--.

Signed and Sealed this

Nineteenth Day of July, 1994

*Attest:*

Bruce Lehman

BRUCE LEHMAN

*Attesting Officer*

*Commissioner of Patents and Trademarks*